US010494841B2

(12) United States Patent
Strathmann

(10) Patent No.: US 10,494,841 B2
(45) Date of Patent: Dec. 3, 2019

(54) MOTOR VEHICLE DOOR LOCK

(71) Applicant: Kiekert Aktiengesellschaft, Heiligenhaus (DE)

(72) Inventor: Michael Strathmann, Velbert (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 663 days.

(21) Appl. No.: 15/024,410

(22) PCT Filed: Sep. 26, 2014

(86) PCT No.: PCT/DE2014/000483
§ 371 (c)(1),
(2) Date: Apr. 26, 2016

(87) PCT Pub. No.: WO2015/043571
PCT Pub. Date: Apr. 2, 2015

(65) Prior Publication Data

US 2016/0265256 A1 Sep. 15, 2016

(30) Foreign Application Priority Data

Sep. 26, 2013 (DE) ..... 10 2013 016 029

(51) Int. Cl.

| | |
|---|---|
| ***E05B 79/10*** | (2014.01) |
| ***E05B 77/12*** | (2014.01) |
| ***E05B 77/06*** | (2014.01) |
| ***E05B 85/24*** | (2014.01) |
| ***E05B 85/26*** | (2014.01) |

(52) U.S. Cl.
CPC ..... *E05B 79/10* (2013.01); *E05B 77/06* (2013.01); *E05B 77/12* (2013.01); *E05B 85/243* (2013.01); *E05B 85/26* (2013.01)

(58) Field of Classification Search
CPC ..... E05B 77/06; E05B 77/04; E05B 79/10; E05B 77/02; E05B 77/12; Y10T 70/5889; Y10S 292/22; Y10S 292/23; Y10S 292/24
See application file for complete search history.

(56) References Cited

U.S. PATENT DOCUMENTS 3,399,921 A * 9/1968 Trost ..... B60P 7/13 24/458
9,534,424 B2 1/2017 Bendel
(Continued)

FOREIGN PATENT DOCUMENTS

DE 202008012949 4/2010
DE 202008012949 U1 4/2010
(Continued)

OTHER PUBLICATIONS

Machine Translation of DE202008012949U1 by Lexis Nexis Total Patent dated Apr. 21, 2016.
(Continued)

*Primary Examiner* — Mark A Williams
(74) *Attorney, Agent, or Firm* — Woodard, Emhardt, Henry, Reeves & Wagner, LLP

(57) ABSTRACT

The invention relates to a motor vehicle door lock which is equipped with a locking mechanism, an actuating lever mechanism, comprising at least one actuating lever and a coupling lever, and finally at least one blocking element. The blocking element ensures a mechanical connection between the actuating lever and the coupling lever during normal operation. In the event of acceleration forces of a specified magnitude, for example during an accident, the blocking element mechanically separates the actuating lever and the coupling lever. According to the invention, a locking element is provided in addition to the blocking element, said locking element acting on an actuating element for the coupling lever such that at least during an accident, the coupling lever is not just mechanically separated from the actuating lever but additionally assumes the "locked" position.

20 Claims, 4 Drawing Sheets

(56) References Cited

U.S. PATENT DOCUMENTS

| | | | | |
|---|---|---|---|---|
| 2011/0254287 | A1 | 10/2011 | Akizuki et al. | |
| 2012/0068479 | A1* | 3/2012 | Bendel | E05B 81/20 292/200 |
| 2014/0203575 | A1* | 7/2014 | Brickner | E05B 77/12 292/341.17 |
| 2014/0291997 | A1* | 10/2014 | Hunt | E05B 77/06 292/92 |
| 2015/0084351 | A1* | 3/2015 | Scholz | E05B 85/26 292/200 |
| 2015/0115626 | A1* | 4/2015 | Bendel | E05B 85/26 292/195 |

FOREIGN PATENT DOCUMENTS

| | | | |
|---|---|---|---|
| DE | 202009009060 | U1 | 1/2011 |
| DE | 202009009061 | U1 | 1/2011 |
| DE | 20 2011 106 663 | U1 | 3/2013 |
| EP | 1375794 | A2 | 1/2004 |
| EP | 1518983 | A2 | 3/2005 |

OTHER PUBLICATIONS

Machine Translation of EP1518983A2 by Lexis Nexis Total Patent dated Apr. 21, 2016.
Written Opinion dated Apr. 9, 2015 in related PCT/DE2014/000483.
German Office Action issued in related DE102013016029.4 dated Sep. 23, 2014 (pp. 5).
Machine translation of DE202008012949U1 by Patent Translate European Patent Office dated Nov. 14, 2018 (pp. 33).
Machine translation of DE202009009060U1 by Lexis Nexis Total Patent dated Nov. 14, 2018 (pp. 17).
Machine translation of DE202009009061U1 by Lexis Nexis Total Patent dated Nov. 14, 2018 (pp. 20).

* cited by examiner

MOTOR VEHICLE DOOR LOCK

BACKGROUND

The invention relates to a motor vehicle door latch, with a locking mechanism, furthermore with an activation lever system with at least one activation lever and a coupling lever, and with at least one blocking element, which in normal operation makes a mechanical connection between the activation lever and the coupling lever and in the event of acceleration forces of a specified magnitude, for example, in the case of an accident, causes mechanical separation between the activation lever and the coupling lever—directly or indirectly.

It is known that centrifugal or mass locks or crash locks prevent unintentional opening of a door, a flap or a lid on a motor vehicle. Thus, the passengers inside the chassis are optimally protected in the event of an accident and safety equipment which may be located in a motor vehicle lateral door such as airbags, braces, etc. can work optimally. Furthermore, it prevents the passengers being catapulted out of the interior. Diverse designs of such centrifugal, mass or crash locks are known.

The class-specific DE 20 2008 012 949 thus involves a crash lock which works with an elastic element of adjustable length. In this context, a connecting element is executed, with the help of which the pawl is connected with at least one handle unit as part of the locking mechanism. The connecting element is equipped with at least one connecting lever. By pulling the handle, the lever is activated and touches a contour of the pawl. The locking mechanism can thus be opened.

In addition, a locking element is executed in the form of a functional element which is connected with at least a spring-elastic component. The spring-elastic component lengthens in the case of a sudden stress or in the case of an accident. Thus, as a result of the change in length of the spring-elastic component the functional element in question is relocated to a position which blocks or disengages the movement of the pawl. Thus, three-dimensional forces should be able to be controlled and simple positioning facilitated.

The state of the art has fundamentally been proven. However, a so-called 'bouncing' is often observed with such motor vehicle door latches. This occurs inter alia if the motor vehicle door executes springy movements vis-à-vis the motor vehicle chassis when the locking mechanism is in the main ratchet position. Consequently, a relative movement occurs between the pawl and the catch in the main ratchet position. Such bouncing is promoted by a pertaining motor vehicle door demonstrating inevitable elasticities such as a circumferential rubber seal. Such bouncing movements are not only disadvantageous from a noise perspective, but can also lead to functional impairments. This is where the invention is used.

SUMMARY

The invention is based on the technical problem of further developing such a motor vehicle door latch in such a way that noise evolution is reduced during operation and bouncing noises are avoided in particular. Functional safety should also be increased.

In order to solve this technical issue, the invention proposes for a class-specific motor vehicle door latch that in addition to the blocking element a locking element is envisaged which impinges an actuator for the coupling lever in such a way that at least during accident operation the coupling lever is not only mechanically separated from the activation lever, but also assumes its "bolted" position.

Within the scope of the invention, in the first instance—if desired—two blocking elements are therefore used, in the first instance the blocking element which in normal operation effects a mechanical connection between the activation lever and the coupling lever and in accident operation effects a mechanical separation of the two levers. In addition to this blocking element which ensures in detail a distance between the activation lever on the one hand and the coupling lever on the other hand during accident operation, a further blocking element is now executed in accordance with the invention or in addition to the blocking element the locking element already mentioned. This locking element works on an actuator for the coupling lever.

In principle, the actuator and the coupling lever can form a constructional unit. However, in general the actuator and the coupling lever are spatially and structurally separated from one another due to their design. The interaction is such that at least in accident operation in the event of acceleration forces of a specified magnitude the coupling lever is not only mechanically separated from the activation lever, namely by the blocking element, but the locking element, in conjunction with the actuator for the coupling lever, also ensures that the coupling lever assumes its "bolted" position, at least in accident operation. This means that the bolted position of the coupling lever can also be assumed or maintained outside of accident operation. Therefore as soon as the actuator is impinged by the acceleration forces of a specified magnitude to a sufficient extent that with the aid of the locking element the actuator experiences significant impinging for the coupling lever, the actuator ensures that the coupling lever is pivoted from its "unbolted" or "unlocked" position typically previously assumed into the "bolted" or "locked" position.

The consequence of this is that, for example, following the described accident operation or the acceleration forces occurring of a specified magnitude the coupling lever still assumes its "bolted" position. The motor vehicle door latch therefore remains in its bolted state following the described accident operation or after occurrence of the acceleration forces of a specified magnitude. Thus, the previously described "bouncing" cannot occur in principle. Because the coupling lever in the "bolted" position prevents a continuous mechanical connection between, for example, a door handle and the locking mechanism durably or as long as the coupling lever is in its "bolted" position. Any oscillating movements transmitting from the activation lever system to the locking mechanism are consequently not (no longer) observed.

In addition, the construction of the motor vehicle door latch in accordance with the invention is simple and functional. Because in normal operation the blocking element ensures that a mechanical connection is present or effected between the activation lever and the coupling lever. Due to the mechanical connection between the activation lever and the coupling lever in normal operation an impingement of the activation lever also leads to a movement of the blocking element. In actual fact, the blocking element is regularly a disc which is rotated around an axis. In addition, the blocking element usually has a spring, with the help of which the blocking element is coupled with the activation lever. The spring in question is interposed between the blocking element and the activation lever for this purpose.

The spring is advantageously a leg spring. This leg spring regularly possesses a free leg, with which it lies adjacent to the blocking lever. Therefore as soon as the blocking lever experiences an impingement the connected movement of the activation lever is transmitted via the spring in question to the blocking element. As a consequence hereof, the blocking element is pivoted around its axis in normal operation. At the same time, this sequence of actions in the "unbolted" position corresponds to the activation lever being able to impinge the locking mechanism, for example, to its opening via the mechanically connected coupling lever.

On the contrary, if the coupling lever is in its "bolted" position, relevant activations of the activation lever are fruitless. Nevertheless, in this process the blocking element is pivoted. Consequently, overall its durable functionality remains over the entire lifetime of the motor vehicle door latch in accordance with the invention.

The locking element envisaged in addition to the blocking element is usually an inert mass or a weight. Generally, the locking element is rotatably located on the activation lever. In addition, a spring may be interposed between the locking element and the activation lever.

As soon as the locking element opposite the activation lever experiences a deflection in accident operation, for example, this deflection is only implemented if the connected inertia forces overcome the forces acting in the opposite direction of the interposed spring.

As already described at the start, the locking element works on an actuator for the coupling lever. The actuator itself is formed as a spring element. The spring element is typically a leg spring. Furthermore, the actuator is regularly arranged on the activation lever.

The locking element generally has an actuator contour for the actuator or spring element or leg spring. The actuator contour usually works on a free leg of the leg spring. The design is such that the locking element interacts via the interposed spring with the change of coupling lever.

If the actuator contour on the locking element impinges the spring or its free (spring) leg, the coupling lever does not experience an impingement and typically maintains an "unbolted" position. However, if the locking element opposite the activation lever is pivoted for example during accident operation and if the actuator contour as a result becomes disengaged with the free leg of the leg spring or the actuator element, this free leg can pivot the coupling lever, and usually from its previously assumed "unbolted" position into the "bolted" position.

This means the accident operation or the acceleration forces of a specified magnitude occurring generally lead on the one hand to the blocking element holding the activation lever firm. Because in this context the activation lever is not able to move the inert mass of the blocking element via the interposed spring. Instead, the blocking element mainly remains at rest. Consequently, in this process at best the interposed spring is (slightly) elastically deformed.

As the activation lever in accident operation is held firm by the blocking element so to speak or is largely held firm, the activation lever can also not work on the coupling lever (which is in the unbolted position) in such a way that the activation lever system impinges the locking mechanism to open as in normal operation. Instead, in accident operation a mechanical separation is effected between the activation lever and the coupling lever and the locking mechanism cannot be opened.

At the same time, the acceleration forces of the specified magnitude ensure that on the other hand the locking element is pivoted vis-à-vis the activation lever. Because the locking element is pivotably located on the activation lever, taking into consideration the spring interposed between the locking element and the activation lever. In accident operation, the inertia forces now also exerted on the locking element ensure that the locking element is pivoted away so to speak from the activation lever immobilized with the aid of the blocking element. The spring interposed between the locking element and the activation lever is stretched in the process.

At the same time as the pivoting movement of the locking element vis-à-vis the activation lever the actuator contour moves away from the actuator element for the coupling lever. Thus, the actuator element for the coupling lever or the relevant free leg of the leg spring at this point becomes free and can impinge the coupling lever. With the aid of the free leg of the actuator or the leg spring envisaged at this point the coupling lever is transferred from the "unbolted" position previously assumed into the "bolted" position.

As soon as the motor vehicle door latch returns to its normal position in this context the coupling lever is still is in its "bolted" position. Only when the locking element actively moves towards the activation lever and the actuator contour resets the free leg can the coupling lever be reset from its "bolted" position into the "unbolted" position. This means that the leg spring or locking spring can be reset to its start position by activation of the bolting in the opposite direction. The motor vehicle door latch in accordance with the invention subsequently reverts to its basic position.

It should be emphasized that the scenario described for accident operation is not necessarily linked to acceleration forces which predominate in such a crash case, typically more than 4 g. But basically the described functionality is also guaranteed if the acceleration forces are exerted by an operator with a quick pulling of the door handle, for example. That depends on the respective design. The acceleration forces in question typically work in the vehicle Y direction, this means in a transverse direction, in contrast to the longitudinal direction of the motor vehicle which is regularly identified with the X direction. The Z direction describes the vertical axis direction in contrast.

As a result a motor vehicle door latch is provided in which in particular oscillation behavior occurring during bouncing does not have/no longer has an impact on the opening process. Because the latch is automatically transferred to its "bolted" position in the case of acceleration in the mentioned Y direction of a specified magnitude. Because upwards of a certain threshold value for the acceleration forces in question the locking element experiences the described pivoting vis-à-vis the activation lever. Consequently, the actuator contour on the locking element releases the actuator or the spring executed here or leg spring or locking spring. The released locking spring is then able to transfer the coupling lever from its previously assumed "unbolted" position to the "bolted" position.

This all takes place taking into account a functional construction, because the blocking element in particular is impinged and pivoted periodically in normal operation together with the activation lever. Any malfunctions are consequently not to be feared. Furthermore, the invention works with a small number of components; consequently, the costs are manageable. These are the crucial advantages.

Hereinafter, the invention is explained in further detail on the basis of a sketch which only depicts an execution example. It shows:

DETAILED DESCRIPTION OF THE DRAWINGS

Figure 1:
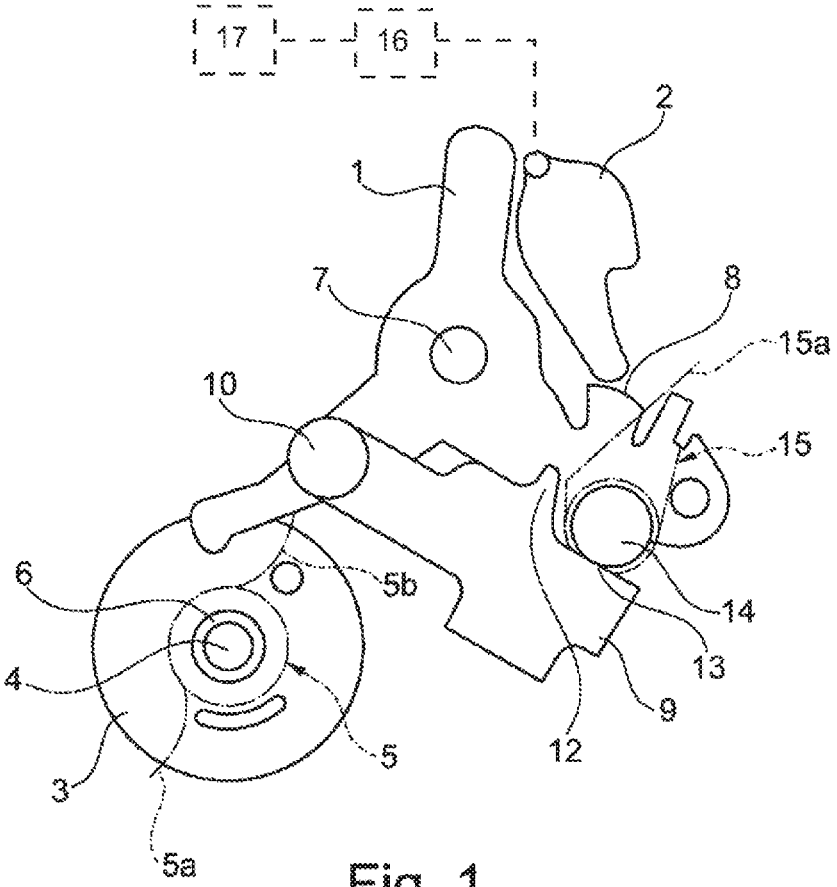
FIG. 1 an installation position of the motor vehicle door latch in accordance with the invention, FIG. 2 the motor vehicle door latch in its basic position, FIG. 3 the motor vehicle door latch in accordance with FIG. 2 at the start of accident operation and FIG. 4 the motor vehicle door latch in accordance with FIG. 3 at the end of accident operation.

In the figures a motor vehicle door latch is depicted which possesses a locking mechanism consisting of a catch 17 and a pawl 16. An activation lever system 1, 2 which is equipped with at least one activation lever 1 and also a coupling lever 2 in the execution example works on the locking mechanism. The activation lever 1 is not restrictively an external activation lever 1.

The further fundamental construction comprises at least a blocking element 3, which in the present case is formed as a disc 3 rotatable around an axis 4. The blocking element 3 has a pertaining spring 5, which is formed as a leg spring 5.

It is recognized that coils of the leg spring 5 encompass a middle pin 6 of the disc or the blocking element 3. The leg spring or spring 5 has a leg 5*a* connected to the disc 3 and a free leg 5*b*.

The spring 5 or its free leg 5*b* is adjacent to the activation lever or the external activation lever 1. In normal operation and in the "unbolted" position of the coupling lever 2 depicted in FIG. 2 an impingement of the activation lever or external activation lever 1 around its axis 7 in the indicated anti-clockwise direction leads to an edge 8 striking the activation lever 1 on the coupling lever 2 and impinging the coupling lever 2.

Figure 2:
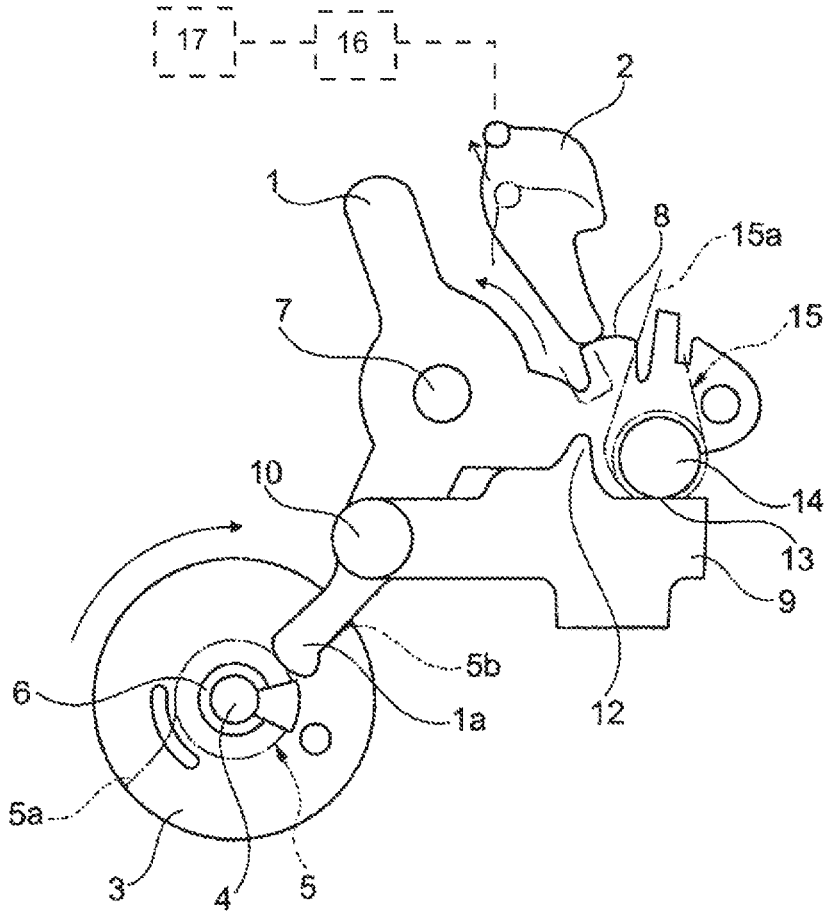

With the aid of the activation lever or the external activation lever 1 in the normal operation indicated in FIG. 2 and in the "unbolted" position the coupling lever 2 is impinged in such a way that the pawl 16 is lifted from the catch 17 with its help—either directly or indirectly. This means that in normal operation in accordance with FIG. 2 the locking mechanism can be opened in the known manner. In this process, the blocking element 3 or the disc 3 is simultaneously pivoted around its axis 4 in a clockwise direction as indicated by a relevant arrow in FIG. 2.

However, if starting from the functional position in accordance with FIG. 2 acceleration forces F of a specified magnitude now occur, the activation lever 1 would again be pivoted around its axis 7 in an anti-clockwise direction if the blocking element 3 in the indicated accident operation did not mechanically separate from the activation lever 1 and the coupling lever 2. In accordance with the invention, this mechanical separation is implemented and attained by the blocking element 3 blocking the activation lever or external activation lever 1 with the occurring acceleration forces F of a specified magnitude, i.e. in accident operation.

Figure 3:
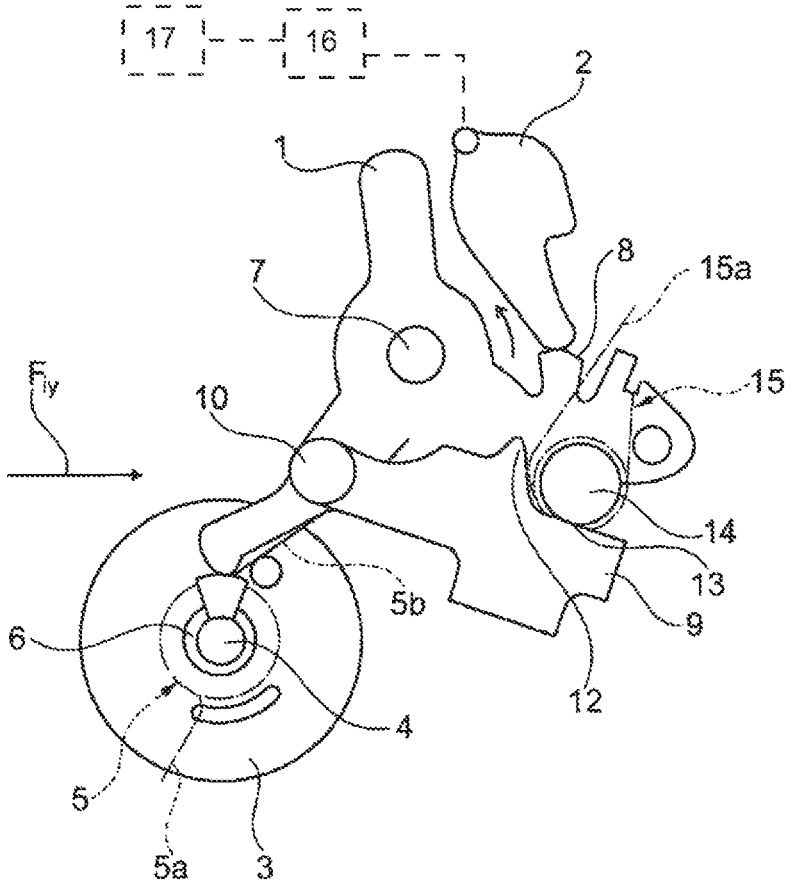

Because in accident operation in accordance with FIG. 3 the blocking element 2 remains in its starting position in accordance with FIG. 1 due to its mass inertia, consequently, any movements of the activation lever 1 only lead to the spring 5 interposed between the blocking element 3 and the activation lever 1 experiencing elastic deformation. This is depicted in FIG. 3. This elastic deformation of the spring 5 corresponds to the activation lever 1 at best being slightly pivoted in an anti-clockwise direction. However, this (slight) pivoting movement is not sufficient by far for the stop or (stop) edge 8 to reach or be able to reach the coupling lever 2. As a consequence hereof the accident operation indicated also does not lead to the locking mechanism being opened.

Later on in accident operation a supplementary locking element 9 comes into play in addition to the blocking element 3. This locking element 9 is fundamentally an inert mass which is pivotably connected via a bolt 10 to the activation lever or the external activation lever 1. As a result of this pivotable location the locking element 9 can accomplish a clockwise direction movement vis-à-vis the external activation lever 1, as recognized in the transition from FIG. 3 to FIG. 4. This clockwise movement of the locking element 9 vis-à-vis the activation lever 1 is attenuated or decelerated by a spring 11 being interposed between the locking element 9 and the activation lever 1 which is elastically deformed during deflection of the locking element 9 vis-à-vis the activation lever 1 and builds up relevant resetting forces.

Figure 4:
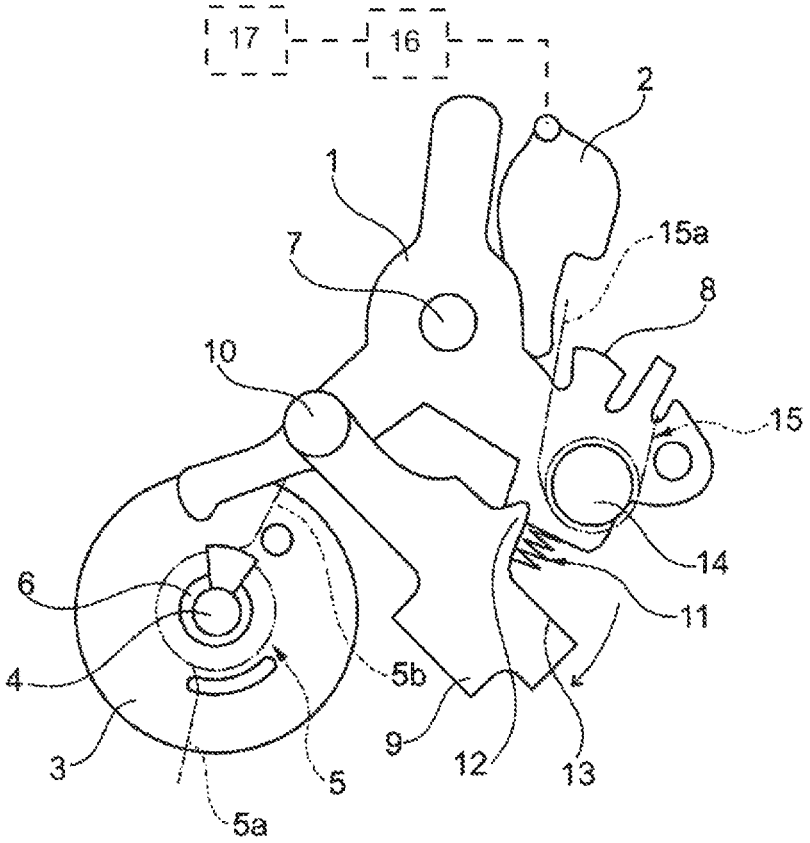

The locking element 9 pivotably located on the activation lever 1 is equipped with an actuator contour 12. In addition, a stop 13 is recognized for a stop bolt 14 on the activation lever 1. The spring 11 ensures that the locking element 9 with its stop 13 lies adjacent to the stop bolt 14 in normal operation and the clockwise rotational movements of the locking element 9 depicted in FIG. 4 are possible and permitted against the force of the spring 11 only in accident operation.

With the aid of the actuator contour 12 the locking element 9 works on an actuator element 15 for the coupling lever 2. The actuator element 15 for the coupling lever 2 is a spring element 15 in the execution example which in the present case is equipped as a leg spring 15. The leg spring 15 has a free spring leg 15*a*, which is adjacent on the coupling lever 2 as soon as the actuator contour 12 on the locking element 9 does not/no longer impinges the actuator element 15 or the leg spring 15 as depicted in FIG. 4. Furthermore, the leg spring 15 is connected to the stop bolt 14.

It operates as follows. In normal operation within the scope of FIG. 2 the coupling lever 2 is pivoted with the aid of the activation lever 1 pivoted around the axis 7 in an anti-clockwise direction or by striking on the stop or edge 8 in such a way that the activation lever system 1, 2 overall cannot open the locking mechanism which is not depicted or is able to lift the pawl 16 from the catch 17.

In this case, the locking element 9 is located adjacent to the activation lever 1, for which the spring 11 is responsible. Furthermore, the actuator contour 12 on the locking element 9 ensures that the free spring leg 15*a* of the leg spring 15 or the actuator element 15 for the coupling lever 2 is not adjacent to the coupling lever 2. At the same time, the pivoting movement of the activation lever 1 in an anti-clockwise direction around its axis 7 ensures that the blocking element 3 accomplishes the clockwise direction movement indicated in FIG. 2. Because the activation lever 1 takes along the free spring leg 5*b* of the spring 5 on the blocking element 3 via its jib 1*a*. The spring 5 is not compressed, instead the blocking element 3 experiences the previously described pivoting movement in a clockwise direction around its axis 4.

If during comparison of FIG. 2 with FIG. 3 acceleration forces F of a specified magnitude are exemplarily exerted on the motor vehicle door latch in accordance with the invention in the depicted V-direction, the blocking element 3 remains at rest due to its mass inertia forces. However, the activation lever 1 is also impinged with the relevant force F and attempts to accomplish an anti-clockwise direction movement around the axis 7—similarly to during normal operation in accordance with the depiction in accordance with FIG. 2. Relevant arrows in FIG. 3 depict this.

However, such an anti-clockwise direction movement of the activation lever 1 is not possible for the accident operation depicted in FIG. 3 because the inertia forces allow the blocking element 3 to remain at rest and only slight movements of the activation lever 1 with elastic deformation of the spring 5 are permitted between the activation lever 1 and the blocking element 3. In fact, in this case the jib 1*a* works on the free spring leg 5*b* of the spring 5 in such a way that the spring 5 is slightly elastically deformed. However, the associated slight movements of the activation lever 1 are not sufficient to be able to impinge the coupling lever 2. Contact therefore explicitly does not occur between the stop or the edge 8 on the activation lever 1 and the coupling lever 2. The locking mechanism is not opened in accordance with wishes.

Furthermore, the acceleration forces F of a specified magnitude ensure according to FIG. 4 in the accident operation scenario that the locking element 9 is pivoted vis-à-vis the connecting bolt 10 or due to its rotatable location on the activation lever 1. The interplay between the stop 13 on the locking lever 9 and the stop bolt 14 in conjunction with the spring 11 only permit a pivoting movement of the locking element 9 in relation to the joint bolt 10 or the thus formed rotational axis 10 in a clockwise direction. This is recognized in the transition from FIG. 3 to FIG. 4.

The pivoting movement of the locking element 9 takes place against the spring force 11. The actuator contour 12 on the locking element 9 releases the free spring leg 15*a* of the spring element 15. Thus, the free spring leg 15*a* can pivot the coupling element 2 into the "bolted" position, as depicted in FIG. 4 and is clear during transition from the "unbolted" position into the "bolted" position shown in FIGS. 1 to 3 in accordance with FIG. 4.

As a consequence hereof, the motor vehicle door latch is in the "bolted" position. Thus, any oscillations of the activation lever system 1, 2 or the activation lever 1 are not transferred to the locking mechanism, because such oscillation movements of the activation lever system 1 are fruitless vis-à-vis the coupling lever 2 in the "bolted" position.—With the aid of an actuator or mechanically the coupling lever 2 can be returned to its "unbolted" position in accordance with FIGS. 1 to 3. Then the motor vehicle door latch in accordance with the invention is again in its starting position in accordance with FIG. 2 in principle.

The leg spring 15 in the execution example is located on the stop bolt 4 which is arranged on the activation lever 1. In further execution examples which are not depicted the leg spring 15 can also be located on a latch housing, a latch case or latch plate.

The invention claimed is:

1. A motor vehicle door latch adapted for use with a locking mechanism to avoid unintended opening of the motor vehicle door latch in the event of an accident that results in the motor vehicle door latch experiencing acceleration forces of a specified magnitude, the motor vehicle door latch comprising:

a catch, a pawl, an activation lever system with at least one activation lever and one coupling lever, wherein the coupling lever is movable between an "unbolted" position where the activation lever can move the coupling lever to move the pawl and a "bolted" position where activation lever cannot move the coupling lever or the pawl, at least one blocking element, which, in normal operation, maintains a mechanical connection between the activation lever and the coupling lever and, in accident operation with occurring acceleration forces of the specified magnitude, causes a mechanical separation of the activation lever relative to the coupling lever, and a locking element which impinges an actuator element for the coupling lever in such a way that, in accident operation when the motor vehicle door latch is subjected to acceleration forces of the specified magnitude, the coupling lever is mechanically separated from the activation lever and the coupling lever is placed in the "bolted" position.

2. The motor vehicle door latch in accordance with claim 1, wherein the actuator element is a spring element.

3. The motor vehicle door latch in accordance with claim 2, wherein the spring element is a leg spring with at least one free spring leg.

4. The motor vehicle door latch in accordance with claim 1, wherein the actuator element is arranged on a latch housing, on a latch case or on a latch plate.

5. The motor vehicle door latch in accordance with claim 1, wherein the locking element is rotatably located on the activation lever.

6. The motor vehicle door latch in accordance with claim 5, wherein a spring is interposed between the locking element and the activation lever.

7. The motor vehicle door latch in accordance with claim 6, wherein the locking element defines an actuator contour for the actuator element.

8. The motor vehicle door latch in accordance with claim 1, wherein the blocking element is a disc rotatable around an axis.

9. The motor vehicle door latch in accordance with claim 1, further comprising an interposed spring that couples the blocking element with the activation lever.

10. The motor vehicle door latch in accordance with claim 9, wherein the spring is a leg spring with at least one free leg adjacent on the activation lever.

11. The motor vehicle door latch in accordance with claim 6, wherein, in normal operation, the locking element moves with the activation lever and in accident operation, the locking element moves relative to the activation lever.

12. The motor vehicle door latch in accordance with claim 11, wherein the actuator element is adapted to move the coupling lever from the "unbolted" position to the "bolted" position when the locking element moves relative to the activation lever.

13. A motor vehicle door latch mechanism adapted for use with a locking mechanism to avoid unintended opening of the motor vehicle door latch in the event of an accident that results in the motor vehicle door latch experiencing acceleration forces of a specified magnitude, the motor vehicle door latch mechanism comprising:

a catch, a pawl, a coupling lever that actuates the locking mechanism, wherein the coupling lever is movable between an "unbolted" position and a "bolted" position;

an activation lever that is rotatable in a first direction to engage said coupling lever when said coupling lever is in the "unbolted" position such that the activation lever can move coupling lever to move the pawl and wherein, in the "bolted" position, rotation of said activation lever does not engage said coupling lever;

a blocking element which, in normal operation, maintains a connection between said activation lever and said coupling lever and, in accident operation with occurring acceleration forces of the specified magnitude, blocks said activation lever from rotating in the first direction such that the activation lever cannot move the coupling lever;

a locking element which, in normal operation, moves with said activation lever and in accident operation, moves relative to said activation lever; and an actuator element adapted to move said coupling lever from the "unbolted" position to the "bolted" position when said locking element moves relative to said activation lever.

14. The motor vehicle door latch in accordance with claim 13, further comprising an interposed spring that couples said blocking element with said activation lever.

15. The motor vehicle door latch in accordance with claim 14, wherein, during normal operation, movement of said activation lever biases said interposed spring which moves said blocking element and wherein, in accident operation, movement of said activation lever does not move said blocking element.

16. The motor vehicle door latch in accordance with claim 15, wherein said blocking element is a disc rotatable around an axis.

17. The motor vehicle door latch in accordance with claim 13, further comprising a spring that couples said locking element to said activation lever, wherein, during normal operation, said spring moves said locking element with said activation lever and wherein, in accident operation, said spring is biased when said locking element moves relative to said activation lever.

18. The motor vehicle door latch in accordance with claim 13, wherein said actuator element is a spring.

19. The motor vehicle door latch in accordance with claim 18, wherein said locking element defines an actuator contour that biases said spring away from said coupling lever in normal operation and wherein, when said locking element moves relative to said activation lever, the actuator contour releases said spring to act on said coupling lever to move said coupling lever from the "unbolted" position to the "bolted" position.

20. The motor vehicle door latch in accordance with claim 19, wherein said locking element is pivotably connected to said activation lever.

* * * * *